US008016726B2

(12) United States Patent
Abiemo et al.

(10) Patent No.: US 8,016,726 B2
(45) Date of Patent: Sep. 13, 2011

(54) PORTABLE EXERCISE DEVICE AND SYSTEM

(76) Inventors: Charity Abiemo, Pearl City, HI (US); Richard Abiemo, Pearl City, HI (US)

( * ) Notice: Subject to any disclaimer, the term of this patent is extended or adjusted under 35 U.S.C. 154(b) by 0 days.

(21) Appl. No.: 12/272,858

(22) Filed: Nov. 18, 2008

(65) Prior Publication Data

US 2010/0125027 A1 May 20, 2010

(51) Int. Cl.
*A63B 71/00* (2006.01)
*A63B 26/00* (2006.01)

(52) U.S. Cl. ..... 482/8; 482/140; 482/142; 482/145; 482/909

(58) Field of Classification Search ..... 482/1, 8, 482/140, 141, 142, 145, 909; 968/411, 412; 368/89
See application file for complete search history.

(56) References Cited

U.S. PATENT DOCUMENTS

| | | | | | |
|---|---|---|---|---|---|
| 1,905,019 | A * | 4/1933 | Turner | 482/123 |
| 1,953,857 | A * | 4/1934 | Hunter | 482/140 |
| 2,046,653 | A * | 7/1936 | Petcoff | 482/140 |
| 3,580,083 | A * | 5/1971 | Zipser | 73/865.4 |
| 4,403,773 | A * | 9/1983 | Swann | 482/130 |
| 4,593,902 | A * | 6/1986 | Michaelsen | 482/140 |
| 4,629,180 | A * | 12/1986 | Kaya | 482/140 |
| 4,735,195 | A * | 4/1988 | Blum et al. | 601/33 |
| 4,968,029 | A * | 11/1990 | Cossin | 482/142 |
| 5,098,089 | A * | 3/1992 | Harrington et al. | 482/140 |
| 5,100,130 | A * | 3/1992 | Shoebrooks | 482/121 |
| 5,328,434 | A * | 7/1994 | Carroll | 482/140 |
| 5,328,435 | A * | 7/1994 | Ricks | 482/140 |
| 5,417,636 | A * | 5/1995 | Havens | 482/145 |
| 5,466,205 | A * | 11/1995 | McLane et al. | 482/140 |
| 6,026,526 | A * | 2/2000 | Payman | 5/602 |
| 6,689,028 | B2 * | 2/2004 | Smith | 482/148 |
| 7,198,592 | B1 * | 4/2007 | Mancini | 482/140 |
| 7,207,932 | B1 * | 4/2007 | Dean | 482/140 |
| 2006/0160672 | A1 * | 7/2006 | Appleby | 482/84 |
| 2007/0021282 | A1 * | 1/2007 | Karp | 482/140 |
| 2007/0129220 | A1 * | 6/2007 | Bardha | 482/82 |

* cited by examiner

*Primary Examiner* — Loan Thanh
*Assistant Examiner* — Sundhara M Ganesan
(74) *Attorney, Agent, or Firm* — Jerry D. Haynes; Law Office of Jerry D. Haynes

(57) ABSTRACT

Disclosed is a portable exercise device for enabling a user to perform sit-up exercises. Also disclosed is a portable exercise system that comprises the portable exercise device, and a mat for supporting a back portion of the user while performing the sit-up exercises. The portable exercise device comprises a base member having a pair of base portions foldably coupled to each other and a pair of pedal portions configured on the pair base portions, a pair of strap members coupled to the pair of pedal portions, a pair of support members removably coupled at end portions of the pair of pedal portions, and a counting unit movably mounted on the base member. The counting unit comprises a timer adapted to determine a period of the sit-up exercises, at least one pressure, and a counter operatively coupled to the at one pressure sensor to determine a number of the sit-up exercises.

11 Claims, 2 Drawing Sheets

PORTABLE EXERCISE DEVICE AND SYSTEM

FIELD OF THE INVENTION

The present invention relates generally to exercise systems, and, more particularly, to a portable exercise device and a portable exercise system adapted for enabling a user to perform sit-up exercises.

BACKGROUND OF THE INVENTION

In today's fitness conscious world, people exercise on a routine basis to stay fit and healthy. For example, people perform various physical exercises, such as sit-ups, push-ups, jogging, and weight-lifting, to stay fit and healthy. Sit-up exercises are preferred by most people desirous of strengthening their abdominal and thigh muscles, and for increasing stamina while jogging. Further, strengthening of abdominal muscles helps in avoiding back problems. Generally, people perform sit-up exercises with the assistance of another person. Specifically, the assistance of another person may be required to securely support feet of a person performing the sit-up exercises.

Various exercise devices for performing sit-up exercises are well known in the art that enable a person to perform the sit-up exercises independently, thereby precluding the need for assistance of another person. However, such exercise devices include complex configuration mechanism, thereby requiring substantial amount of time for configuring the exercise devices before being utilized for performing sit-up exercises. Moreover, such exercise devices are not capable of providing information regarding the performance of a person using the exercise device. Additionally, such exercise devices are bulky in construction and, therefore, are difficult to be carried from one place to another.

Accordingly, there exists a need for a portable exercise device, which may be easily configured to perform sit-up exercises. Further, there exists a need for a portable exercise device, which enables a user to perform sit-up exercises in a manner such that the user is updated about his/her performance of the sit-up exercises.

SUMMARY OF THE INVENTION

In view of the foregoing disadvantages inherent in the prior art, the general purpose of the present invention is to provide a portable exercise device for performing sit-up exercises, configured to include all the advantages of the prior art, and to overcome the drawbacks inherent therein.

Accordingly, an object of the present invention is to provide a portable exercise device for enabling a user to perform sit-up exercises in a manner such that the user is updated about his/her performance of the sit-up exercises.

Another object of the present invention is to provide a portable exercise device which may be easily configured by a user to perform sit-up exercises.

Yet another object of the present invention is to provide a portable exercise system utilizing a portable exercise device for enabling a user to perform sit-up exercises.

In light of the above objects, in one aspect of the present invention, a portable exercise device for a user to perform sit-up exercises is disclosed. The portable exercise device comprises a base member, a pair of strap members, a pair of support members, and a counting unit. The base member comprises a pair of base portions foldably coupled to each other, and a pair of pedal portions configured on the pair of base portions. The pair of pedal portions is adapted to receive feet of the user for enabling the user to perform the sit-up exercises. The pair of strap members is coupled to the pair of base portions in a manner such that the pair of strap members extends over the pair of pedal portions for securing the feet of the user to the pair of pedal portions. The pair of support members is adapted to be removably coupled at end portions of the pair of pedal portions. The pair of support members is adapted to support heel portions of the feet of the user received on the pair of pedal portions. The counting unit is foldably mounted on the base member. The counting unit comprises a timer, at least one pressure sensor, and a counter. The timer is adapted to determine a period of the sit-up exercises performed by the user. The at least one pressure sensor is coupled to at least one pedal portion of the pair of pedal portions. The least one pressure sensor is adapted to determine a pressure applied by a foot of the user on the at least one pedal portion while performing the sit-up exercises. The counter is operatively coupled to the at least one pressure sensor for determining a number of the sit-up exercises performed by the user based on the pressure determined by the at least one pressure sensor.

In another aspect of the present invention, a portable exercise system for a user to perform sit-up exercises is disclosed. The portable exercise system comprises a portable exercise device, and a mat. The portable exercise device comprises a base member, a pair of strap members, a pair of support members, and a counting unit. The base member comprises a pair of base portion foldably coupled to each other, and a pair of pedal portions configured on the pair of pedal portions. The pair of pedal portions is adapted to receive feet of the user for enabling the user to perform the sit-up exercises. The pair of strap members is coupled to the pair of base portions in a manner such that the pair of strap members extends over the pair of pedal portions for securing the feet of the user to the pair of pedal portions. The pair of support members is adapted to be removably coupled at end portions of the pair of pedal portions. The pair of support members is adapted to support heel portions of the feet of the user received on the pair of pedal portions. The counting unit is foldably mounted on the base member. The counting unit comprises a timer, at least one pressure sensor, and a counter. The timer is adapted to determine a period of the sit-up exercises performed by the user. The at least one pressure sensor is coupled to at least one pedal portion of the pair of pedal portions. The least one pressure sensor is adapted to determine a pressure applied by a foot of the user on the at least one pedal portion while performing the sit-up exercises. The counter is operatively coupled to the at least one pressure sensor for determining a number of the sit-up exercises performed by the user based on the pressure determined by the at least one sensor. The mat is adapted to be positioned in the vicinity of the portable exercise device for supporting a back portion of the user thereon while performing the sit-up exercises.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWING

The advantages and features of the present invention will become better understood with reference to the following detailed description and claims taken in conjunction with the accompanying drawing, in which:

Like reference numerals refer to like parts throughout the description of several views of the drawings.

DETAILED DESCRIPTION OF THE INVENTION

The exemplary embodiments described herein detail for illustrative purposes are subject to many variations in implementation thereof. It should be emphasized, however, that the present invention is not limited to a portable exercise device and a portable exercise system for performing sit-up exercises, as shown and described. It is understood that various omissions and substitutions of equivalents are contemplated as circumstances may suggest or render expedient, but these are intended to cover the application or implementation without departing from the spirit or scope of the claims of the present invention.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present invention provides a portable exercise device, which may be utilized for performing sit-up exercises. The portable exercise device may be conveniently carried by a user from one place to another, and may be easily configured for performing sit-up exercises. The portable exercise device finds use in homes, offices, health clubs, gymnasiums, and the like. Further, the present invention provides a portable exercise system that utilizes the portable exercise device for enabling a user to perform sit-up exercises.

The term, "sit-up exercise," as used herein, refers to a single sit-up routine performed by a user by upwardly moving his/her shoulders and back, towards his/her pelvic region once. The user may perform a plurality of such sit-up routines (referred to as "sit-up exercises") to strengthen his/her abdominal muscles.

Figure 1:
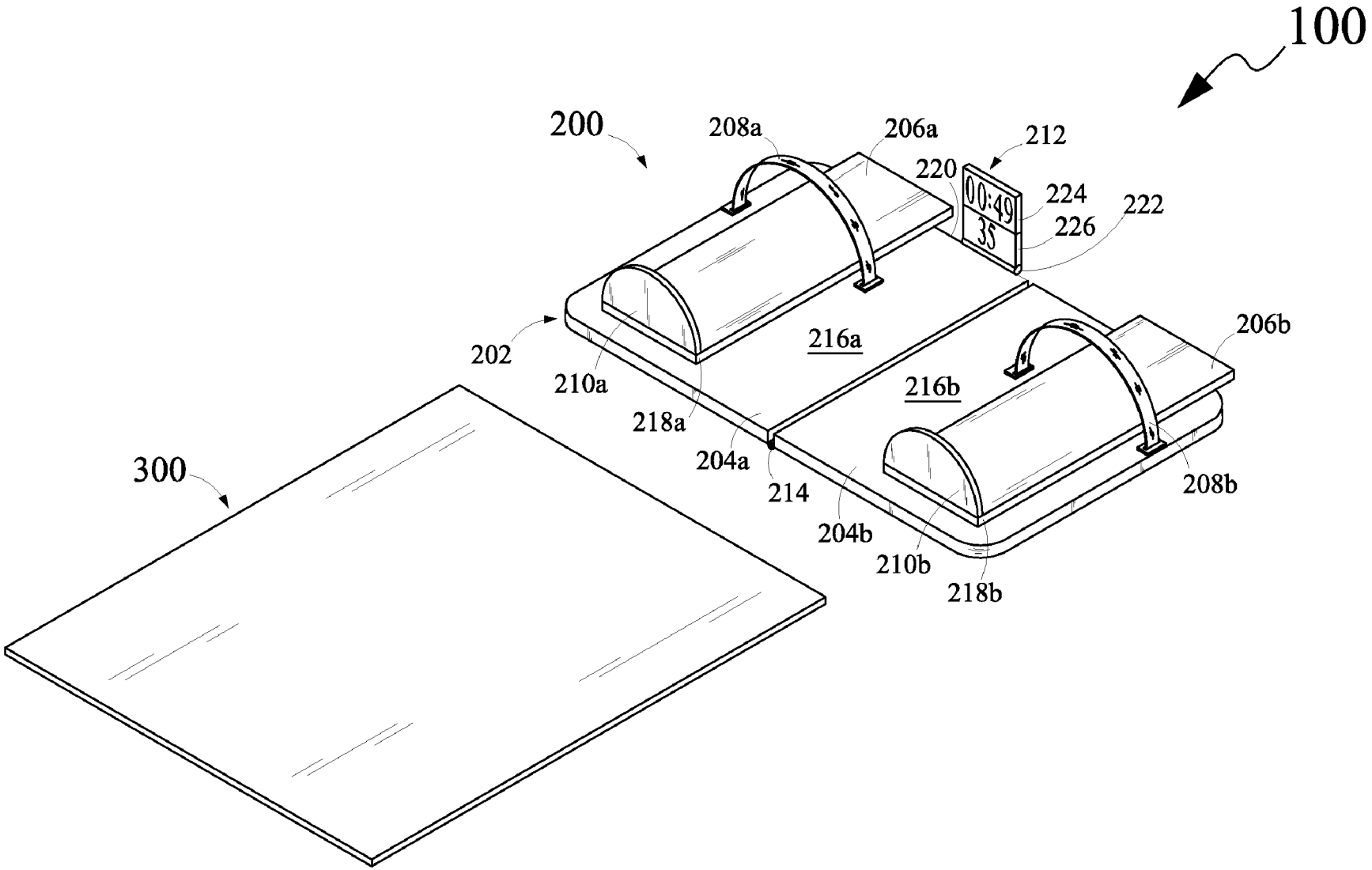
FIG. 1 illustrates a perspective view of a portable exercise system utilizing a portable exercise device, in accordance with an exemplary embodiment of the present invention.

Referring now to FIG. 1, a perspective view of a portable exercise system 100 (hereinafter referred to as "exercise system 100") is illustrated, in accordance with an exemplary embodiment of the present invention. The exercise system 100 includes a portable exercise device 200 (hereinafter referred to as "exercise device 200") for enabling a user to perform sit-up exercises and a mat 300 adapted to be utilized in conjunction with the exercise device 200 while performing the sit-up exercises.

The exercise device 200 includes a base member 202 having a pair of base portions, such as base portions 204*a* and 204*b* (hereinafter collectively referred to as base portions 204), foldably coupled to each other, and a pair of pedal portions, such as pedal portions 206*a* and 206*b* (hereinafter collectively referred to as pedal portions 206), configured on the base portions 204. The exercise device 200 further includes a pair of strap members, such as strap members 208*a* and 208*b* (hereinafter collectively referred to as strap members 208), coupled to the base portions 204, a pair of support members, such as support members 210*a* and 210*b* (hereinafter collectively referred to as support members 210), adapted to be removably coupled to the pedal portions 206*a* and 206*b*, and a counting unit 212 foldably mounted on the base member 202.

As shown in FIG. 1, the base portions 204 are configured to assume rectangular plate like structure. However, it will be evident to a person skilled in the art that the base portions 204 may be configured to assume any other shape, such as a circular plate structure, an elliptical plate structure, and a polygonal plate structure. As explained herein, the base portions 204 are foldably coupled to each other. More specifically, the base member 202 includes a hinge arrangement 214 configured between the base portions 204 for foldably coupling the base portion 204. In one embodiment of the present invention, the hinge arrangement 214 may include at least one hinge configured between the base portions 204. Further, the hinge arrangement 214 may be coupled to bottom surfaces (not shown) of the base portions 204 for enabling the foldably coupling therebetween. Moreover, as explained herein, the base portions 204 are configured with the pedal portions 206. Specifically, the pedal portions 206 are configured on top surfaces of the base portions 204. For example, the pedal portion 206*a* is configured on a top surface 116*a* of the base portion 204*a* and the pedal portion 206*b* is configured on a top surface 116*b* of the base portion 204*b*.

The pedal portions 206 are adapted to receive feet of a user for providing a firm platform to the user for resting his/her feet thereon, thereby enabling the user to perform sit-up exercises. In the present embodiment, the pedal portions 206 are configured to assume rectangular plate like structure. However, it will be obvious to a person skilled in the art that the pedal portions 206 may be configured to assume any other shape, apart from the rectangular plate like structure, which is capable of comfortably receiving the feet of the user thereon.

The strap members 208 are coupled to the base portions 204 in a manner such that the strap members 208 extend over the pedal portions 206. Specifically, the strap members 208 are adapted for securing the feet of the user on the pedal portions 206 while the user is performing sit-up exercises. The strap members 208 are coupled to the base portions 204 in a manner such that that strap members 208 extend over the pedal portions 206 for configuring as a pair of loop like structure (shown in FIG. 1) capable of receiving the feet of the user therethrough for securing the feet on the pedal portions 206. For example, the strap member 208*a* is coupled to the top surface 216*a* of the base portion 204*a* and extends over the pedal portion 206*a* for configuring as a loop like structure adapted to receive a left foot of the user. Similarly, the strap member 208*b* is coupled to the top surface 216*b* of the base portion 204*b* and extends over the pedal portion 206*b* for configuring as a loop like structure adapted to receive a right foot of the user. Particularly, the strap members 208 secure toe portions or in step portions of the feet of the user on the pedal portions 206.

In one embodiment of the present invention, the strap members 208 are capable of being adjusted in length for adapting to different users. More specifically, the strap members 208 are capable of being adjusted in length to secure feet of different sizes thereby enabling the exercise device 200 to be utilized by different users. In one embodiment of the present invention, the strap members 208 may be composed of a soft stretchable material such that the strap members 208 are capable of being expanded and contracted to adjust to feet of different sizes.

As explained hereinbefore, the support members 210 are adapted to be removably coupled to the pedal portions 206 such that the support members 210 extend vertically from the base portions 204, as shown in FIG. 1. More specifically, the support members 210 are adapted to be removably coupled at respective end portions of each of the pedal portions 206 for supporting heel portions of the feet received on the pedal portions 206. For example, the support member 210*a* is removably coupled to an end portion 218*a* of the pedal portion 206*a* for supporting a heel portion of the left foot received on the pedal portion 206*a*. Similarly, the support member 210*b* is removably coupled to an end portion 218*b* of the pedal portion 206*b* for supporting a heel portion of the right foot received on the pedal portion 206*b*.

In one embodiment of the present invention, the end portions 218*a* and 218*b* of the pedal portions 206 may be configured with a groove (not shown) capable of removably receiving a portion (not shown) of each of the support members 210 for removably coupling the support members 210 with the pedal portions 206. However, it will be evident to a person skilled in the art that the support members 210 may be removably coupled with the pedal portions 206 by utilizing any other coupling mechanism known in the art.

As explained hereinbefore, the counting unit 212 is foldably mounted on the base member 202. In the present embodiment, the counting unit 212 is foldably mounted on a peripheral edge 220 of the base portion 204*a*. More specifically, the counting unit 212 may be coupled to the peripheral edge 220 with the help of a hinge member 222 for enabling foldable mounting therebetween. The hinge member 222 enables the counting unit 212 to be folded and positioned on the top surface 216*a* of the base portion 204*a* such that the counting unit 212 is positioned in a parallel orientation with respect to the base portion 204*a*. The counting unit 212 may be folded when the exercise device 200 is not being used for performing sit-up exercises. While using the exercise device 200, the counting unit 212 may be unfolded about the hinge member 222 to be positioned vertically with respect to the base portion 204*a*, as shown in FIG. 1.

The counting unit 212 includes a timer 224, at least one pressure sensor (not shown), and a counter 226. The timer 224 is adapted to determine a period for which the user performs the sit-up exercises. More specifically, in the present embodiment, the timer 224 may be a digital timer, which may be turned "ON" by the user while commencing sit-up exercises and turned "OFF" at conclusion of the sit-up exercises, for determining the period of the sit-up exercises performed by the user. In the present embodiment, the at least one pressure sensor is coupled to at least one pedal portion, such as the pedal portion 206*a*. Specifically, in the present embodiment, the at least one pressure sensor is disposed beneath the pedal portion 206*a* and is coupled thereto for determining a pressure applied by a left foot of the user on the pedal portion 206*a* while performing the sit-up exercises. It will be evident to person skilled in that the counting unit 212 may include two pressure sensors (not shown) disposed beneath each of the pedal portions 206.

Further, the counter 226 is operatively coupled to the at least one pressure sensor for determining a number of the sit-up exercises performed by the user. More specifically, the counter 226 is adapted to determine the number of the sit-up exercises based on the pressure determined by the at least one pressure sensor. Specifically, while performing the sit-up exercises, pressure is applied by feet of the user on the pedal portion 206 that is determined by the at least one pressure sensor. In the present embodiment, the at least one pressure sensor is disposed beneath the pedal portion 206*a*, accordingly, the at least one pressure sensor senses the pressure applied by the left foot on the pedal portion 206*a*, which is further communicated to the counter 226. For example, when the user performs the sit-up exercises, particularly, upwardly moving his/her shoulders towards his/her pelvic region, the left foot of the user applies pressure on the pedal portions 206*a*. Accordingly, the pressure applied by the feet of the user is determined by the at least one pressure sensor, which is communicated to the counter 226 in the form of an electronic signal, such as pulses. In one embodiment of the present invention, an electronic signal is generated each time the at least one pressure sensor determines the pressure applied by the foot of the user.

The counter 226 receives the electronic signal from the at least one pressure sensor and starts counting the number of the sit-up exercises based on the electronic signal. Accordingly, the counter 226 enables in determining the number of the sit-up exercises performed by the user based on the pressure applied by feet of the user. Further, the user may utilize the value of the number of the sit-up exercises determined by the counter 226 and the period determined by the timer 218 to analyze his/her performance of the sit-up exercises.

It will be, however, evident to a person skilled in the art that the timer 224 and the counter 226 are capable of working independently, and may be utilized individually by the user for determining either a period or a number of sit-up exercises performed by him/her. The counting unit 212 further includes a power source (not shown) electrically coupled to the timer 224, the at least one pressure sensor, and the counter 226. In one embodiment of the present invention, the electrically coupling of the power source with the timer 224, the at least one pressure sensor, and the counter 226 is enabled by using electrical wires. Specifically, the power source provides electrical power to the timer 224, the at least one pressure sensor, and the counter 226. In one embodiment of the present invention, the power source may include at least one battery electrically coupled to the timer 224, the at least one pressure sensor, and the counter 226. Further, in one embodiment of the present invention, the timer 224 and the counter 226 may include a digital display for digitally showing the period of the sit-up exercises and the number of sit-up exercises, respectively.

In use, the exercise system 100 of the present invention may be easily configured by the user for performing sit-up exercises. Specifically, the exercise device 200 and the mat 300 may be positioned in vicinity of each other. The exercise device 200 may be configured by placing the base member 202 on a substantially flat surface, such as a floor of a house. Thereafter, the mat 300 is positioned in the vicinity of the exercise device 200 in a manner such that the mat 300 is adapted to support a back portion of the user performing the sit-up exercises with the help of the exercise device 200. In one embodiment of the present invention, the mat 300 is composed of a rubber material. Accordingly, the mat 300 of the present invention provides a flexible and comfortable surface for supporting the back portion, such as a hip portion and a lower spine portion of the user thereon.

Upon placing himself/herself on the mat 300, the user may position his/her feet on the pedal portions 206. Specifically, the feet of the user are received on the pedal portions 206 through the loop like structures configured by the strap members 208. Accordingly, the feet of the user are firmly secured to the pedal portions 206. The support members 210 are coupled to the end portions 218*a*, and 218*b* of the pedal portions 206 for supporting the heel portions of the feet received by the pedal portions 206. Thereafter, the user may turn on at least one of the timer 224 and the counter 226 and rest his/her back portion on the mat 300 for commencing the sit-up exercises. Specifically, the user upwardly moves his/her shoulders and back, towards his/her pelvic region to perform the sit-up exercises. The timer 224 and the counter 226 may reflect the period and the number of sit-up exercises, respectively, performed by the user thereby enabling him/her to judge his/her performance. By knowing his/her performance, the user may have a better idea of his/her stamina and may be encouraged to set higher performance goals for him/her.

Figure 2:
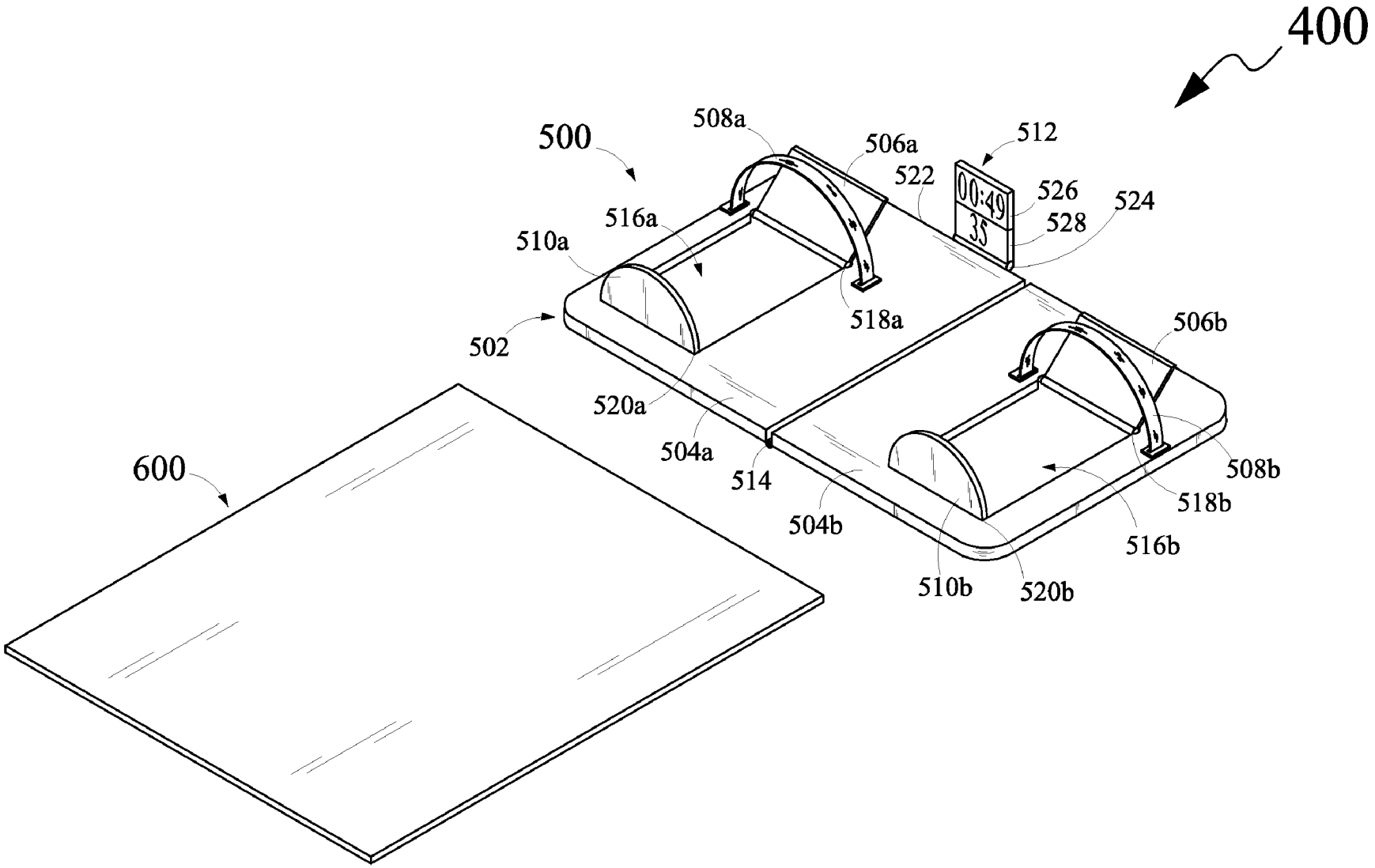
FIG. 2 illustrates a perspective view of a portable exercise system utilizing a portable exercise device, in accordance with another exemplary embodiment of the present invention.

The exercise device, as explained herein, is subject to many variations. In one embodiment of the present invention, the pedal portions of the exercise device may be configured on the base portions in a manner such that the pedal portions may be adapted to be inclined to the base portions at certain predetermined angles. By changing an angle of inclination between the pedal portions and the base portions, the exercise device may be used for performing sit-up exercises of different difficulty levels, which is explained in detail herein conjunction with FIG. 2. Referring now to FIG. 2, a perspective view of a portable exercise system 400 (hereinafter referred to as "exercise system 400") is illustrated, in accordance with another exemplary embodiment of the present invention. The exercise system 400 includes a portable exercise device 500 (hereinafter referred to as "exercise device 500") and a mat 600. In the present embodiment, the structural configuration and functionality of the mat 600 of the exercise system 400 is similar to the structural configuration and functionality of the mat 300 of the exercise system 100. Accordingly, a detailed explanation of the mat 600 of the exercise system 400 has been avoided for sake of brevity.

The exercise device 500 includes a base member 502 having a pair of base portions, such as base portions 504*a* and 504*b* (hereinafter collectively referred to as "base portions 504"), foldably coupled to each other, and a pair of pedal portions, such as pedal portions 506*a* and 506*b* (hereinafter collectively referred to as "pedal portions 506"), foldably mounted on the base portions 504. The exercise device 500 further includes a pair of strap members, such as strap members 508*a* and 508*b* (hereinafter collectively referred as "strap members 508"), coupled to the base portions 504, a pair of support members, such as support members 510*a* and 510*b* (hereinafter collectively referred to as "support members 510"), adapted to be removably coupled to the base portions 504, and a counting unit 512 foldably mounted on the base member 502. In the present embodiment, the structural configuration and functionality of the strap members 508 of the exercise device 500 is similar to the structural configuration and functionality of the strap members 208 of the exercise device 200. Accordingly, a detailed explanation of the strap members 508 of the exercise device 500 has been avoided for sake of brevity.

As explained herein, the base portions 504 are foldably coupled to each other. More specifically, the base member 502 includes a hinge arrangement 514 configured between the base portions 504 for foldably coupling the base portions 504. In the present embodiment, the structural configuration and functionality of the hinge arrangement 514 of the exercise device 500 is similar to the structural configuration and functionality of the hinge arrangement 214 of the exercise device 200. Accordingly, a detailed explanation of the hinge arrangement 514 of the exercise system 400 has been avoided for sake of brevity.

Further, as explained herein, the pedal portions 506 are foldably mounted on the base portions 504. More specifically, the pedal portion 506*a* is foldably mounted on an end portion of a channel 516*a*, configured of the base portion 504*a*. Similarly, the pedal portion 506*b* is foldably mounted on an end portion of a channel 516*b*, configures on the base portion 504*b*. For example, the pedal portion 506*a* is foldably mounted on a first end portion 518*a* of the channel 516*a*, and the pedal portion 506*b* is foldably mounted on a first end portion 518*b* of the channel 516*b*. Moreover, as explained herein, the support members 510 are removably coupled to the base portions 504. More specifically, the support members 510 are removably coupled to other end portions of the channels 516*a* and 516*b*, configured of the base portions 504*a* and 504*b*, respectively. For example, the support member 510*a* is removably coupled a second end portion 520*a* of the channel 516*a*, and support member 510*b* is removably coupled a second end portion 520*b* of the channel 516*b*. In one embodiment of the present invention, the support member 510*a* may be removably coupled the second end portion 520*a* of the channel 516*a* by a groove (not shown) configured on the second end portion 520*a*. Similarly, the support member 510*b* may be removably coupled a second end portion 520*b* of the channel 516*b* by a groove (not shown) configured on the second end portion 520*a*. In the present embodiment, the structural configuration and functionality of the support members 510 of the exercise device 500 is similar to the structural configuration and functionality of the support members 210 of the exercise device 200. Accordingly, a detailed explanation of the support members 510 of the exercise device 500 has been avoided for sake of brevity.

In the present embodiment, the foldable mounting of the pedal portions 506*a* and 506*b* on the first end portions 518*a* and 518*b*, respectively, is enabled by a protruded portion and groove arrangement. More specifically, lower end portions of the pedal portions 506*a* and 506*b* may be configured with protruded portions (not shown) extending sideways from the lower end portions. Further the first end portions 518*a* and 518*b* of the channels 516*a* and 516*b*, respectively, may be configured with grooves (not shown). The grooves of the first end portions 518*a* and 518*b* are capable of receiving the protruded portions, configured on the lower end portions of the pedal portions 506*a* and 506*b*, thereby rotatably mounting the pedal portions 506*a* and 506*b* on the first end portions 518*a* and 518*b*, respectively. Accordingly, the pedal portions 506*a* and 506*b* are capable of being folded about the first end portions 518*a* and 518*b* of the channels 516*a* and 516*b*, respectively.

The pedal portions 506 are adapted to receive feet of a user for providing a firm platform to the user for resting his/her feet thereon, thereby enabling the user to perform sit-up exercises. More specifically, the pedal portions 506 are adapted to receive toe portions of the feet of the user in a manner such that the toe portions are secured to the pedal portions 506 with the help of the strap members 508. Further, as shown in FIG. 2, the pedal portions 506 of the exercise device 500 are inclined to the base portions 504 at a predetermined angle. More specifically, the mounting of the lower end portions of the pedal portions 506 on the first end portions 518*a* and 518*b* of the channels 516*a* and 516*b*, respectively, enables in retaining the pedal portions 506 at the predetermined angle while the user is performing the sit-up exercises. Moreover, the pedal portions 506 may be folded by rotating the pedal portions 506 in a manner such that the pedal portions 506 are received by the channels 516*a* and 516*b*.

As explained hereinbefore, the counting unit 512 is foldably mounted on the base member 502. In the present embodiment, the counting unit 512 is foldably mounted on a peripheral edge 522 of the base portion 504*a*. More specifically, the counting unit 512 is coupled to the peripheral edge 522 with the help of a hinge member 524 for enabling foldable mounting therebetween. The counting unit 512 includes a timer 526, at least one pressure sensor (not shown), and a counter 528. In the present embodiment, the structural configuration and functionality of the timer 526 and the counter 528 of the counting unit 512 is similar to the structural configuration and functionality of the timer 224 and the counter 226 of the counting unit 212. Accordingly, a detailed explanation of the timer 526 and the counter 528 of the counting unit 512 has been avoided for sake of brevity.

Further, the at least one pressure sensor is coupled to at least one pedal portion of the pedal portions 506. In present embodiment, the at least one pressure sensor of the counting unit 512 is disposed between a pedal portion, such as the pedal portion 506*a*, and a base portion, such as the base portion 504*a*. For example, the at least one pressure sensor of the counting unit 512 is disposed between the lower end portion of the pedal portion 506*a* and the first end portion 518*a* of the channel 516*a*. However, it will be evident to person skilled in the art that the counting unit 512 may include two pressure sensors disposed between the lower end portions of the pedal portions 506 and the first end portions 518*a* and 518*b* of the channels 516*a* and 516*b*, respectively. In the present embodiment, the at least one pressure sensor is capable of sensing a pressure applied by the left foot of the user on the pedal portion 506*a*. The pressure sensed by the at least one pressure sensor is communicated to the counter 528 for determining a number of the sit-up exercises performed by the user, as explained herein conjunction with FIG. 1. Accordingly, the timer 526 and the counter 528 may reflect a period and the number of sit-up exercises, respectively, performed by the user thereby enabling him/her to analyze his/her performance.

The portable exercise device and system, as described herein, may be easily configured for performing sit-up exercises in a manner such that a user is informed of his/her performance of the sit-up exercises. Further, the portable exercise system of the present invention may be conveniently carried by the user from one place to another and may be easily stored when not in use. Specifically, the foldable coupling between the base portions, such as the base portions 204, and removable coupling of the support members, such as the support members 210, enables the portable exercise device to be easily storable. Further, the counting unit may be folded to be positioned on the base member, such as the base member 202. Furthermore, the mat such as the mat 300 may be conveniently folded and stored at an appropriate place. Moreover, the components and simple mechanism for configuring the portable exercise system enables the portable exercise system to be cost effective.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the claims of the present invention.

What is claimed is:

1. A portable exercise device for user to perform sit-up exercises, the portable exercise device comprising:

a base member comprising a pair of base portions foldably coupled to each other, and a pedal portion coupled on top of each of the base portions, each pedal portion adapted to receive a foot of the user for enabling the user to perform the sit-up exercises;

a pair of strap members coupled to the pair of base portions in a manner such that a strap member extends over each pedal portion for securing a foot of the user to each pedal portion;

a pair of support members adapted to be removably coupled at end portions of each pedal portion, the pair of support members adapted to support heel portions of the feet of the user received on each pedal portion; and a counting unit foldably mounted on the base member, the counting unit comprising a timer adapted to determine a period of the sit-up exercises performed by the user, at least one pressure sensor coupled to at least one pedal portion, the at least one pressure sensor adapted to determine a pressure applied by foot of the user on the pedal portion while performing the sit-up exercises, and a counter operatively coupled to the at least one pressure sensor for determining a number of the sit-up exercises performed by the user based on the pressure determined by the at least one pressure sensor.

2. The portable exercise device of claim 1, wherein the counting unit further comprises a power source electrically coupled to the timer, the at least one pressure sensor, and the counter.

3. The portable exercise device of claim 2, wherein the power source comprises at least one battery.

4. The portable exercise device of claim 1, wherein the each of the pair of strap members is kept capable of being adjusted in length.

5. The portable exercise device of claim 1, wherein the base member further comprises a hinge arrangement configured between the pair of base portions for foldably coupling the pair of base portions.

6. A portable exercise device for user to perform sit-up exercises, the portable exercise device comprising:

a base member comprising a pair of base portions foldably coupled to each other, and a pedal portion coupled on top of each of the base portions, each pedal portion adapted to receive a foot of the user for enabling the user to perform the sit-up exercises;

a pair of strap members coupled to the pair of base portions in a manner such that a strap member extends over each pedal portions for securing a foot of the user to each pedal portion;

a pair of support members adapted to be removably coupled at end portions of each pedal portion, the pair of support members adapted to support heel portions of the feet of the user received on each pedal portion; and a counting unit foldably mounted on the base member, the counting unit comprising a timer adapted to determine a period of the sit-up exercises performed by the user, at least one pressure sensor coupled to at least one pedal portion, the at least one pressure sensor adapted to determine a pressure applied by foot of the user on the pedal portion while performing the sit-up exercises, and a counter operatively coupled to the at least one pressure sensor for determining a number of the sit-up exercises performed by the user based on the pressure determined by the at least one pressure sensor; and a mat adapted to be positioned in the vicinity of the portable exercise device for supporting a back portion of the user thereon while performing the sit-up exercises.

7. The portable exercise device of claim 6, wherein the counting unit further comprises a power source electrically coupled to the timer, the at least one pressure sensor, and the counter.

8. The portable exercise device of claim 7, wherein the power source comprises at least one battery.

9. The portable exercise device of claim 6, wherein the each of the pair of strap members is kept capable of being adjusted in length.

10. The portable exercise device of claim 6, wherein the base member further comprises a hinge arrangement configured between the pair of base portions for foldably coupling the pair of base portions.

11. The portable exercise system of claim 6, wherein the mat is composed of a rubber material.

* * * * *